US007673871B2

(12) United States Patent
Bokelman et al.

(10) Patent No.: US 7,673,871 B2
(45) Date of Patent: Mar. 9, 2010

(54) SHEET FEEDER

(75) Inventors: Kevin Bokelman, San Diego, CA (US); Glenn W. Gaarder, Ramona, CA (US); Ryan M. Smith, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/258,836

(22) Filed: Oct. 27, 2008

(65) Prior Publication Data

US 2009/0283960 A1 Nov. 19, 2009

Related U.S. Application Data

(60) Provisional application No. 61/053,496, filed on May 15, 2008.

(51) Int. Cl.
*B65H 3/06* (2006.01)

(52) U.S. Cl. ..... 271/117

(58) Field of Classification Search ..... 271/117, 271/274

See application file for complete search history.

(56) References Cited

U.S. PATENT DOCUMENTS

| | | | | |
|---|---|---|---|---|
| 5,348,282 | A | 9/1994 | Choi et al. | |
| 5,527,026 | A | 6/1996 | Padget et al. | |
| 6,227,534 | B1 | 5/2001 | Schoedinger et al. | |
| 6,267,369 | B1 | 7/2001 | Regimbal et al. | |
| 6,382,620 | B1 | 5/2002 | Gaarder et al. | |
| 6,648,322 | B2 | 11/2003 | Park | |
| 6,866,259 | B2 | 3/2005 | Underwood et al. | |
| 6,988,722 | B2 | 1/2006 | Su | |
| 7,116,343 | B2 | 10/2006 | Botten et al. | |
| 2001/0010414 | A1 * | 8/2001 | Yukimachi | 271/9.11 |
| 2004/0245704 | A1 * | 12/2004 | Hall et al. | 271/117 |
| 2005/0280204 | A1 | 12/2005 | Knierim et al. | |
| 2007/0001369 | A1 | 1/2007 | Murrell et al. | |
| 2007/0052153 | A1 | 3/2007 | DeVore et al. | |
| 2008/0006994 | A1 | 1/2008 | Otani et al. | |

* cited by examiner

*Primary Examiner*—David H Bollinger

(57) ABSTRACT

A sheet feeder has a tray for receiving one or more media sheets. An arm is configured to pivot relative to the tray. A roller is rotatably coupled to the arm. A biasing device is coupled to the arm. The biasing device biases the arm to pivot toward the tray.

21 Claims, 3 Drawing Sheets

SHEET FEEDER

CROSS REFERENCE TO RELATED APPLICATIONS

This Application claims the benefit of provisional patent application Ser. No. 61/053,496, filed May 15, 2008; entitled "Sheet Feeder" which application is incorporated by reference herein as if reproduced in full below.

BACKGROUND

Image-capturing devices, such as scanners, all-in-one devices, copiers, etc., sometimes use sheet feeders to feed media sheets, such as printed sheets, photographs, etc., to a scanning portion of the image-capturing device for scanning hardcopy images formed on the media sheets. Sheet feeders typically include a tray for receiving one or more media sheets, e.g., from a user. Some sheet feeders include a roller (e.g., sometimes called a pick roller) rotatably connected to an arm (e.g., sometimes called a pick arm) that is pivotally connected to the imaging device or a stationary portion of the sheet feeder, for example. When one or more media sheets are located in the tray, the arm overlies the media sheets so that the media sheets are interposed between the tray and the roller, with the roller contacting the uppermost media sheet.

The arm may be substantially parallel to the uppermost media sheet, e.g., when the tray is full of media sheets. However, when the tray is less than full, e.g., after a number of media sheets have been fed to the scanning portion, the arm is in a pivoted position relative to when the tray is full and forms an angle with the uppermost media sheet that is equal to the angular distance (e.g., the pivot angle) over which the arm has pivoted.

When torque is applied to the roller, the roller rolls relative to the arm and exerts a tangential force on a surface of the media sheet in contact therewith that causes the media sheet to move. The tangential force is substantially equal to the product of the coefficient of friction between the roller and the media sheet and the force exerted by the roller on the media sheet in a direction normal to the surface of the media sheet (e.g., commonly called the normal force) and perpendicular to the tangential force. It is often desirable to have substantially rolling contact, e.g., little or no slipping, between the roller and the media sheet as the media sheet moves, and, therefore, the coefficient of friction between the roller and the media sheet is substantially the coefficient of rolling friction.

The arm is at different pivot angles for different numbers of media sheets between the roller and the tray. However, the normal force exerted by the roller on the media sheet typically varies as the pivot angle changes, thus causing the tangential force exerted by the roller on the media sheet in contact therewith to change. For example, for some pivot angles, the normal force may result in a tangential force that insufficient to move the media sheet, e.g., the roller may slip relative to the media sheet. For other pivot angles, the normal force may result in a tangential force that is too high, e.g., causing several media sheets to move at once or causing damage to the arm, tray, roller, media sheets, and/or the imaging device.

DETAILED DESCRIPTION

In the following detailed description of the present embodiments, reference is made to the accompanying drawings that form a part hereof, and in which are shown by way of illustration specific embodiments that may be practiced. These embodiments are described in sufficient detail to enable those skilled in the art to practice disclosed subject matter, and it is to be understood that other embodiments may be utilized and that structural and/or mechanical changes may be made without departing from the scope of the claimed subject matter. The following detailed description is, therefore, not to be taken in a limiting sense, and the scope of the claimed subject matter is defined only by the appended claims and equivalents thereof.

Figure 1:
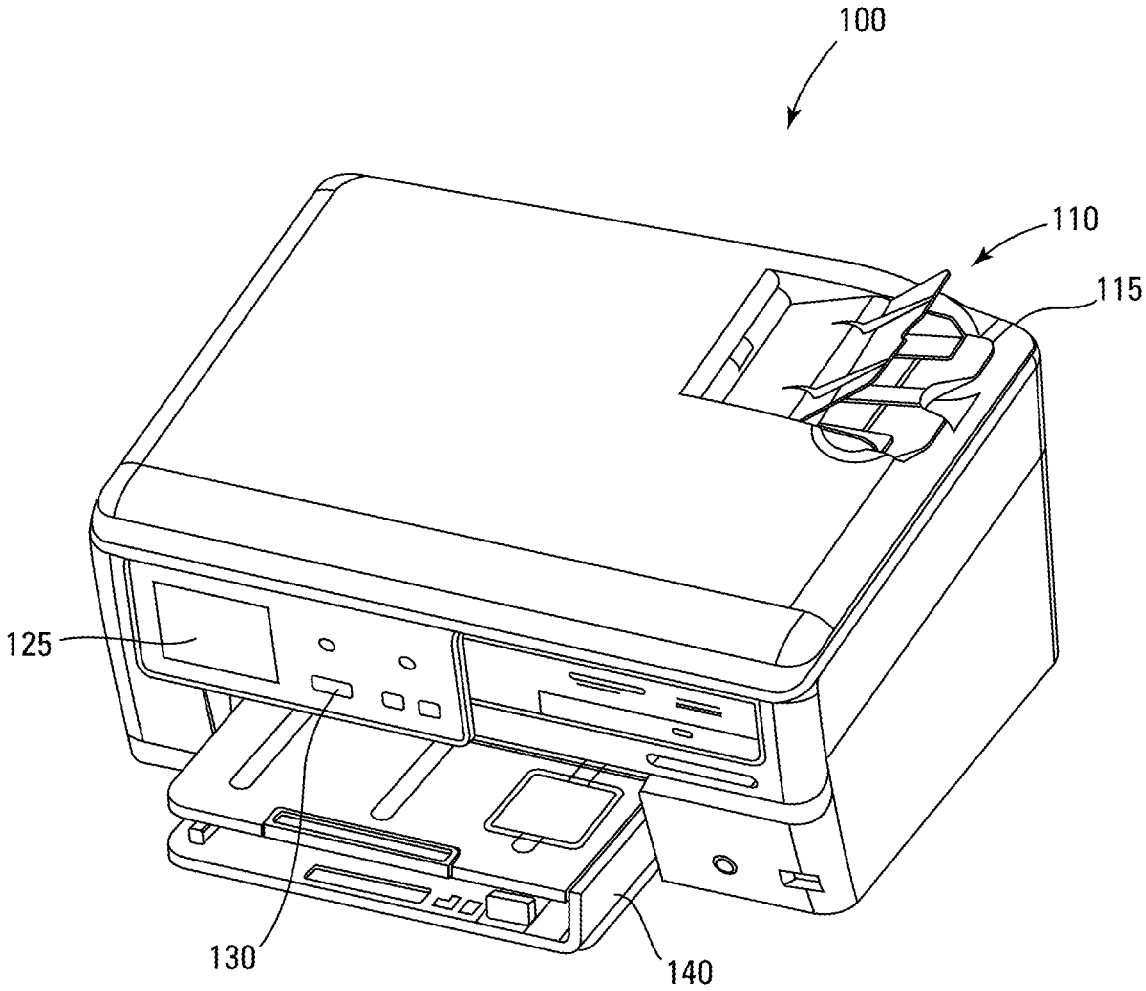
FIG. 1 illustrates an embodiment of an image-capturing device, according to an embodiment of the disclosure.

FIG. 1 illustrates an image-capturing device 100, such as a scanner, an all-in-one device, copier, etc, according to an embodiment. For one embodiment, image-capturing device 100 is configured for scanning photographic media having photographic images formed thereon, e.g., photographs. For another embodiment, a sheet feeder 110 is disposed in a cover 120 of image-capturing device 100. Cover 120 overlies a platen (not shown in FIG. 1) when in the closed position of FIG. 1. Sheet feeder 110 has a tray 115 configured to receive media sheets having hardcopy images formed thereon, such as photographs. For example, a user of image-capturing device 100 inserts the media sheets into the sheet feeder 115. Sheet feeder is further configured to send the media sheets to the platen in response to the user selecting a scan option, e.g., from a display 125 or by actuating a button 130. The media sheets are scanned while on the platen and subsequently sent to an output tray 110.

Figure 2:
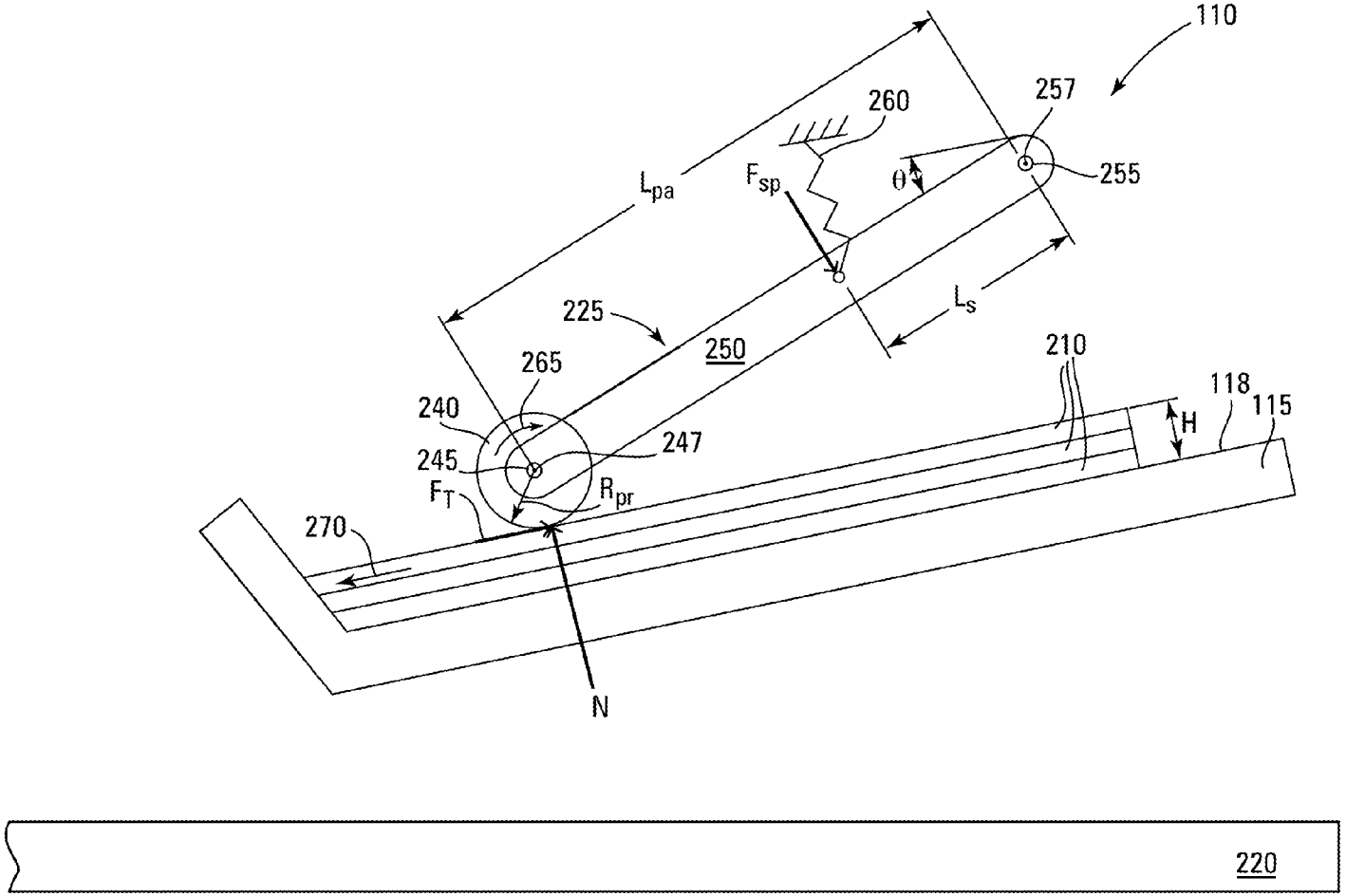
FIG. 2 illustrates an embodiment of a sheet feeder, according to another embodiment of the disclosure.

FIG. 2 illustrates sheet feeder 110, according to another embodiment. It will be appreciated that FIG. 2 is simplified to focus on relevant aspects of the disclosure. In operation, sheet feeder 110 sends a media sheet, such as a photograph 210, to platen 220 for scanning by scanning equipment 230. Scanning equipment 230 scans the hard copy images formed on the media sheet and, for one embodiment, converts them into digital data.

Sheet feeder 110 includes a sheet roller assembly 225 (e.g., sometimes called a pick arm assembly) with a roller 240 (e.g., sometimes called a pick roller), having a radius $R_{pr}$, rotatably coupled to an arm 250 (e.g., sometimes called a pick arm) that is pivotally coupled to a portion of image-capturing device 100 or sheet feeder 110. For example, a shaft 245 may rotatably couple roller 240 to arm 250 so that roller 240 can rotate relative to arm 250 about a longitudinal axis 247 (shown as a dot in FIG. 2) located at the center of shaft 245. A shaft 255 may pivotally couple arm 250 to image-capturing device 100 or sheet feeder 110 so that arm 250 can pivot relative to sheet feeder 110, tray 115, and media sheets 210 about a longitudinal axis 257 (shown as a dot in FIG. 2) located at the center of shaft 255. For example, shaft 255 may be fixedly coupled to sheet feeder 110 or image-capturing device 100 so that arm 250 can move relative to shaft 255. Alternatively, arm 250 may be fixedly coupled to shaft 255, and shaft 255 may be rotatably coupled to sheet feeder 110 or image-capturing device 100. For one embodiment, the longitudinal axes 247 and 257 of shafts 245 and 255 are substantially parallel to each other and are substantially perpendicular to the plane of FIG. 2. For another embodiment, roller 240 may be an elastomer, such as ethylene propylene diene monomer rubber (EPDM), silicone rubber, butadiene rubber, urethane, etc.

For one embodiment, a biasing torque is exerted on arm 250 so that roller 240 is biased against media sheets 210. That is, the biasing torque is directed toward the tray and acts to pivot arm 250 and thus roller 240 toward tray 115 and into a media sheet 210. When there are no media sheets in tray 115, roller 240 is biased against an upper surface 118 (e.g., the surface that receives media sheets 210) of tray 115.

The biasing torque is such that the biasing torque decreases as arm 250 pivots toward tray 115, and a pivot angle θ, measured from θ=0 when arm 250 is parallel to upper surface 118 and thus the upper surface of the uppermost media sheet, increases. During operation, as the height H of the stack of media sheets decreases as media sheets 210 are fed to platen 220, scanned, and delivered to output tray 140 (FIG. 1), arm 250 pivots roller 240 toward tray 115, thereby increasing the pivot angle θ and decreasing the biasing torque exerted on arm 250. Alternatively, as sheets are received between upper surface 118 and roller 240, the height H of the stack of media sheets increases as media sheets 210 are added to tray 115, causing arm 250 to pivot away from upper surface 118, thus decreasing the pivot angle θ and increasing the biasing torque exerted on arm 250.

For one embodiment, the biasing torque is produced by a spring 260 that exerts a biasing force $F_{sp}$ on arm 250 at a distance $L_S$ from longitudinal axis 257, as shown in FIG. 2, where spring 260 is operating in the compression mode for pushing arm 250 toward tray 115. Note that for this embodiment, arm 250 may be interposed between spring 260 and tray 115 so that spring 260 can push arm 250 toward tray 115. During operation, as the height H of the stack of media sheets decreases, spring 260 extends, causing arm 250 to pivot roller 240 toward tray 115. As spring 260 extends, the biasing force $F_{sp}$ on arm 250 is reduced, meaning that the biasing force $F_{sp}$ decreases with increasing pivot angle θ.

In other embodiments, the biasing torque may be produced by a torsion spring, e.g., wrapped around shaft 255 and engaging arm 250 adjacent shaft 255, where the torque produced by the torsion spring decreases with increasing pivot angle θ. In an alternative embodiment, a spring, operating in the tension mode, may be positioned between tray 115 and arm 250, e.g., for producing a biasing force on arm 250 at the distance $L_S$ from longitudinal axis 257. For this embodiment, the tension spring acts to pull arm 250 toward tray 115, with the length of the tension spring decreasing as arm 250 pivots toward tray 115, meaning that the biasing force on arm 250 decreases as the pivot angle θ increases.

During operation, a torque is applied to roller 240 for rotating roller 240, e.g., in an angular direction opposite the angular direction (the θ-direction) in which arm 250 is biased to pivot. For example, roller 240 may be rotated in the clockwise direction, as indicated by arrow 265, whereas arm 250 is biased to pivot in the counterclockwise direction toward tray 115. Rotating roller 240 acts to pivot arm 250 toward the media sheet 210 in contact with roller 240 in the angular direction of the biasing torque. Torque may be applied directly to roller 240 by a motor or through a series of gears or through belts and pulleys.

As roller 240 rotates, the media sheet 210 in contact with roller 240 exerts a tangential force $F_T$ on the periphery (the perimeter) of roller 240 that is equal and opposite to the tangential force exerted by the periphery of roller 240 on that media sheet 210 that moves that media sheet 210 in the direction of arrow 270. For substantial rolling contact between roller 240 and the media sheet, the tangential force $F_T$ on roller 240 is substantially the product of the coefficient of rolling friction between the roller and the media sheet and a normal force N that is normal to the surface of the media sheet 210 in contact with roller 240 and that acts through longitudinal axis 247 of shaft 245. Note that the normal force N is in reaction to a normal force that the roller exerts on the media sheet as the roller rotates and is equal and opposite to that normal force.

A torque balance on arm 250 about longitudinal axis 257, after a torque is applied to roller 240 so that roller 240 is in substantial rolling contact with the uppermost media sheet 210 and is moving that media sheet in the direction of arrow 270, provides the following relation for the normal force N:

$$N=T_S/[L_{pa}(\cos\theta-\mu\sin\theta)-\mu R_{pr}] \quad (1)$$

where $T_S$ is the biasing torque applied to arm 250 that acts to pivot arm 240 toward tray 115, as described above, $L_{pa}$ is the distance between longitudinal axes 247 and 257, as shown in FIG. 2, μ is substantially the coefficient of rolling friction between roller 240 and the media sheet 210, θ is the pivot angle swept out by arm 250 in an angular direction from where arm 250 is parallel to the upper surface 118 of tray 115, and $R_{pr}$ is the radius of roller 240.

For the embodiment shown in FIG. 2, the biasing torque $T_S$ is as follows:

$$T_S=L_S(F_i-k_S L_S\sin\theta) \quad (2)$$

where $L_S$ is the distance from longitudinal axis 257 at which spring 260 acts, $k_S$ is the spring constant (e.g., sometimes called the spring rate) of spring 260, and $F_i$ is the biasing force exerted by spring 260 on arm 250 when arm 250 is parallel (θ=0) with the upper surface 118 of tray 115 and with the surface of the media sheet in contact with roller 240.

Substituting equation (2) into equation (1) gives:

$$N=[L_S(F_i-k_S L_S\sin\theta)]/[L_{pa}(\cos\theta-\mu\sin\theta)-\mu R_{pr}] \quad (3)$$

Figure 3:
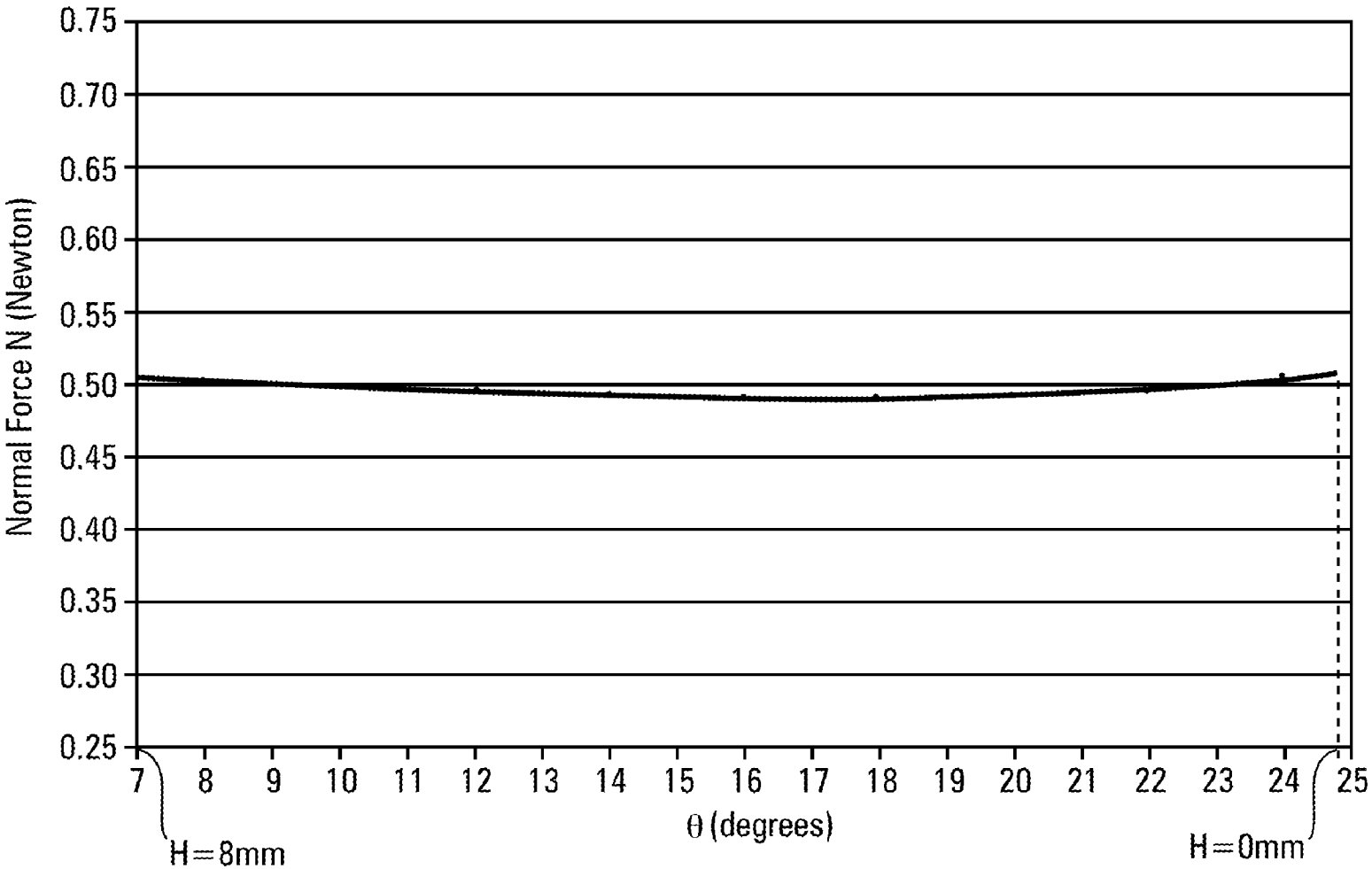
FIG. 3 is a plot of the normal force versus the pivot angle for an example embodiment of a sheet feeder.

FIG. 3 is a plot of equation (3), where $L_{pa}$ is about 27.05 millimeters, $L_S$ is about 13 millimeters, $R_{pr}$ is about 4.925 millimeters, $F_i$ is about 0.85 Newton, $k_S$ is about 0.12 Newton/millimeter, and μ is about 1.2. Note that the normal force N is within five percent of a nominal value (e.g., about 0.5 Newton) for pivot angles from about 7 to about 24.7 degrees.

Note that the pivot angle θ corresponds to the height H of the stack of media sheets, i.e., the pivot angle increases as the height H decreases. For example, for one embodiment, the pivot angle θ decreases from 7 degrees when height H of the stack of media sheets is 8 millimeters to 24.7 degrees when height H is zero millimeters (no media sheets) and roller 240 is biased against the upper surface 118 of tray 115, as shown in FIG. 3. This means that for this embodiment, the normal force N is within five percent of the nominal value for a stack height of zero to about 8 millimeters.

The relatively small variation of normal force is afforded by the biasing torque $T_S$ that acts to pivot arm 250 and thus roller 240 toward tray 115 and that decreases as arm 250 pivots from being parallel with the upper surface 118 of tray 115. This results in a relatively small variation in the tangential force applied to the media sheets 210 by roller 240, e.g., compared to systems that employ springs that act to pull the pick arm away from the media, meaning that only as much tangential force is applied to any media sheet in the stack as needed to move that media sheet. This results in relatively uniform torque requirements for the motor that supplies the torque to roller 240 and acts to reduce the torque requirements of the motor compared to systems that employ springs that act to pull the pick arm away from the media.

CONCLUSION

Although specific embodiments have been illustrated and described herein it is manifestly intended that the scope of the claimed subject matter be limited only by the following claims and equivalents thereof.

What is claimed is:

1. A sheet feeder, comprising:

a tray for receiving one or more media sheets;

an arm configured to pivot relative to the tray;

a roller rotatably coupled to the arm; and a biasing device coupled to the arm that biases the arm to pivot toward the tray;

wherein when there are no media sheets in the tray, the biasing device biases the arm such that the roller is biased against the tray.

2. The sheet feeder of claim 1, wherein a torque exerted by the biasing device on the arm decreases as the arm pivots toward the tray.

3. The sheet feeder of claim 1, wherein the biasing device is a compression spring that acts to push the arm toward the tray.

4. The sheet feeder of claim 1, wherein the biasing device is a tension spring that acts to pull the arm toward the tray.

5. The sheet feeder of claim 1, wherein the biasing device is a torsion spring.

6. The sheet feeder of claim 1, wherein the roller is configured to rotate in an angular direction that is opposite to an angular direction in which the arm is biased to pivot.

7. The sheet feeder of claim 1, wherein the sheet feeder forms a portion of an image capturing device.

8. A sheet feeder, comprising:

a tray for receiving one or more media sheets;

an arm configured to pivot relative to the tray;

a roller rotatably coupled to the arm; and a biasing device coupled to the arm that biases the arm to pivot toward the tray;

wherein the sheet feeder is disposed in a cover of an image capturing device.

9. A sheet feeder, comprising:

a tray for receiving one or more media sheets;

an arm biased to pivot about a first axis in a first angular direction toward the tray; and a roller rotatably coupled to the arm and configured to rotate about a second axis in a second angular direction that is opposite to the first angular direction so as to move a media sheet of the one or more media sheets in a direction away from the first axis when the roller is rotating in the second angular direction while in contact with that media sheet.

10. The sheet feeder of claim 9, wherein the arm is biased such that the roller is biased against the tray.

11. The sheet feeder of claim 10, wherein the arm is biased such that as media sheets are interposed between the roller and the tray, the arm pivots against a biasing torque exerted on the arm.

12. The sheet feeder of claim 11, wherein the biasing torque exerted on the arm decreases as the arm pivots against the biasing force.

13. The sheet feeder of claim 9, wherein a spring in compression, tension, or torsion, biases the arm to pivot about the first axis in the first angular direction toward the tray.

14. The sheet feeder of claim 9, wherein a compression spring is coupled to the arm at a first distance from the first axis for biasing the arm to pivot about the first axis in the first angular direction toward the tray.

15. The sheet feeder of claim 14, wherein the second axis is located at a second distance from the first axis that is greater than the first distance.

16. A method of operating a sheet feeder, comprising:

applying a biasing torque to an arm that acts to pivot the arm toward a media sheet so that a roller rotatably coupled to the arm is biased against the media sheet; and actuating the roller so that the roller rotates relative to the arm and exerts a tangential force on the media sheet that causes the media sheet to move:

wherein when exerting the tangential force on the media sheet, the roller rotates in an annular direction that is opposite an angular direction in which the arm is pivoted toward the media sheet.

17. The method of claim 16, wherein the roller rotates in substantial rolling contact with the media sheet.

18. The method of claim 16, wherein the media sheet moves in a direction that is away from an axis about which the arm pivots.

19. The method of claim 16, wherein applying the biasing torque to the arm comprises using a spring in compression to apply spring force on the arm that acts to push the arm against the media sheet, using a spring in tension to apply spring force on the arm that acts to pull the arm against the media sheet, or using a torsion spring.

20. The method of claim 16, further comprising decreasing the biasing torque as a number of media sheets underlying the roller decreases.

21. The method of claim 16, wherein the roller exerts a normal force on the media sheet that is within about 5 percent of a nominal value of the normal force when the arm is at a pivot angle of about 7 to about 24.7 degrees from being parallel to the media sheet.

* * * * *

UNITED STATES PATENT AND TRADEMARK OFFICE

CERTIFICATE OF CORRECTION

PATENT NO. : 7,673,871 B2
APPLICATION NO. : 12/258836
DATED : March 9, 2010
INVENTOR(S) : Kevin Bokelman et al.

It is certified that error appears in the above-identified patent and that said Letters Patent is hereby corrected as shown below:

In column 16, line 29, in Claim 16, delete "annular" and insert -- angular --, therefor.

Signed and Sealed this

Tenth Day of August, 2010

David J. Kappos

David J. Kappos
*Director of the United States Patent and Trademark Office*